US006681429B2

(12) United States Patent
Mehrmann et al.

(10) Patent No.: US 6,681,429 B2
(45) Date of Patent: Jan. 27, 2004

(54) METHOD FOR THE WET TREATMENT OF LAUNDRY ITEMS

(75) Inventors: Falk F. Mehrmann, Walsrode (DE); Wilhelm Bringewatt, Porta Westfalica (DE)

(73) Assignee: Pharmagg Systemtechnik GmbH, Hoya (DE)

( * ) Notice: Subject to any disclaimer, the term of this patent is extended or adjusted under 35 U.S.C. 154(b) by 0 days.

(21) Appl. No.: 10/082,845

(22) Filed: Feb. 26, 2002

(65) Prior Publication Data

US 2002/0116770 A1 Aug. 29, 2002

(30) Foreign Application Priority Data

Feb. 28, 2001 (DE) ..... 101 09 749

(51) Int. Cl.[7] ..... D06B 3/10

(52) U.S. Cl. ..... 8/158; 68/145; 68/27; 68/58

(58) Field of Search ..... 8/158, 159; 68/18 R, 68/27, 58, 143, 145, 241

(56) References Cited

U.S. PATENT DOCUMENTS 2,700,287 A * 1/1955 Sulzmann
3,431,753 A * 3/1969 Glenn et al.
4,131,483 A * 12/1978 Iwahashi et al.
4,499,621 A * 2/1985 Gasser ..... 8/158
4,527,343 A * 7/1985 Danneberg
4,546,511 A * 10/1985 Kaufmann
4,922,566 A * 5/1990 Ravensbergern
5,723,064 A * 3/1998 Sheppard

FOREIGN PATENT DOCUMENTS

| | | |
|---|---|---|
| DE | 1 006 821 | 4/1957 |
| DE | 44 35 253 A1 | 2/1996 |
| DE | 44 22 631 A1 | 4/1996 |
| DE | 44 35 846 A1 | 4/1996 |
| DE | 100 31 040 A1 | 2/2001 |
| EP | 0 217 981 A1 | 4/1987 |
| EP | 0 731 202 A1 | 9/1996 |
| JP | 2-289298 * | 11/1990 |

OTHER PUBLICATIONS

Copy of German Patent Office search report.
Copy of European Patent Office search report.

* cited by examiner

*Primary Examiner*—Franklin L. Stinson
(74) *Attorney, Agent, or Firm*—Technoprop Colton LLC

(57) ABSTRACT

A method to treat laundry items in the last treatment zone of a tunnel washing machine with a liquid that has a higher temperature than the liquid of the preceding zone, resulting in the liquid of the bound liquor having a higher temperature and making it possible to remove a greater portion of the bound liquor form the laundry items in a hydroextraction press, so that the laundry items leaving the hydroextraction press have only a slight residual moisture which is still has to be removed by drying, thus shortening the drying process and requiring less energy.

15 Claims, 1 Drawing Sheet

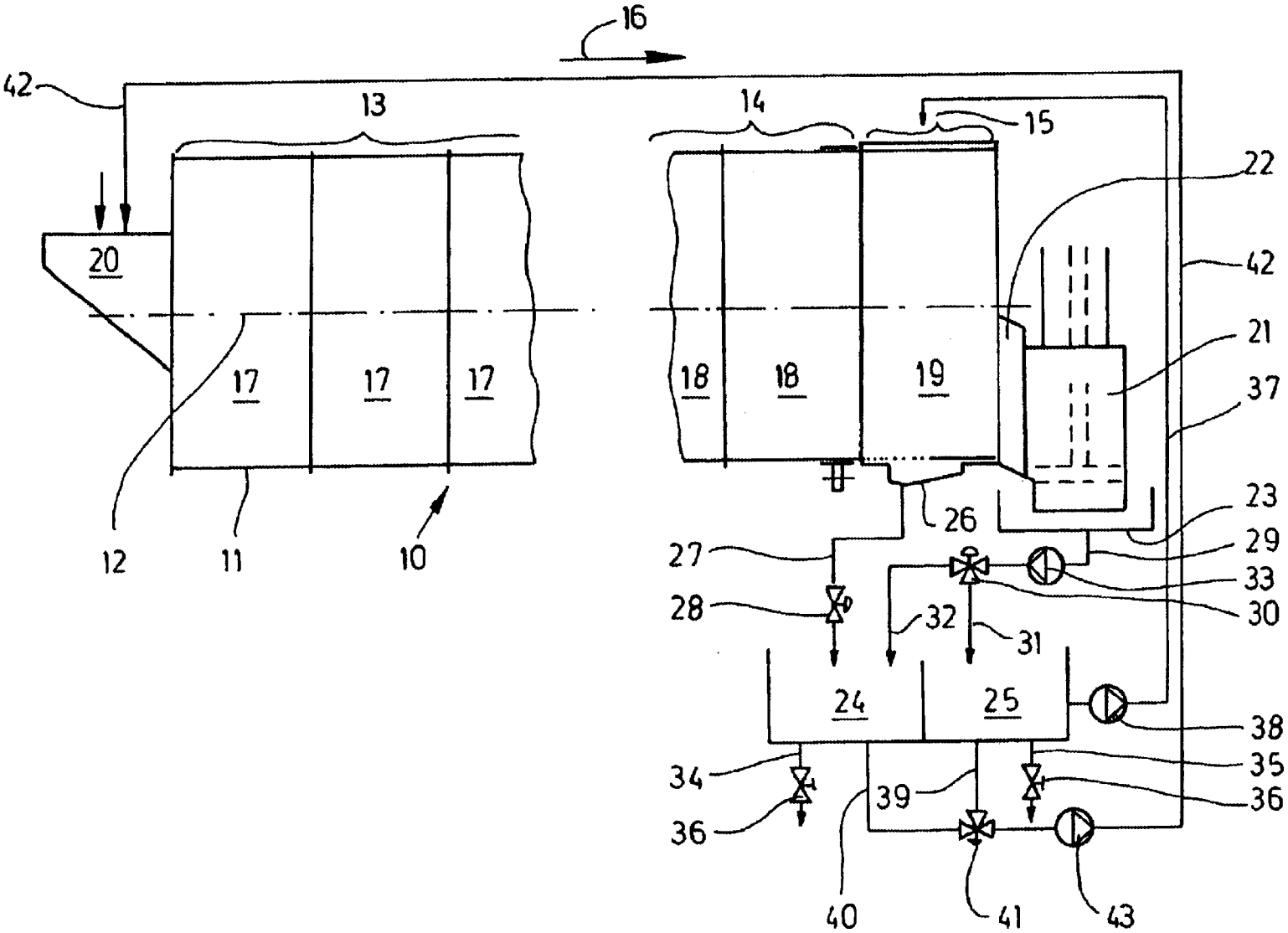
42
22
21
37
23
29
33
30
38
35
36
43
15
19
26
31
25
41
32
39
40
14
18
18
24
27
28
34
36
16
17
17
17
10
13
11
12
20
42

METHOD FOR THE WET TREATMENT OF LAUNDRY ITEMS

DESCRIPTION

The invention relates to a method for the treatment of laundry items, with the laundry items being subjected to different successive wet treatments in successive treatment zones.

During wet treatment, particularly during the washing and rinsing of laundry items, liquids are employed which are essentially water. In the case of aftertreatment, for example, a finishing bath of the laundry items, the liquid contains supplements such as finishing agents. At various stages of treatment the unbound liquid (referred to in the trade as "free liquor") is discharged or separated from the laundry items. At the end of wet treatment a portion of the liquid remaining in the laundry items, the so-called "bound liquor", is separated. Any bound liquor subsequently remaining in the laundry items is removed in the following drying of the laundry items. This drying of the laundry items is very costly in terms of time and energy.

The invention is thus based on the problem of creating a method which simplifies the drying process of the laundry items.

A method for solving this problem is shown in the method disclosed herein. It has been surprisingly shown that by employing a liquid with a higher liquids are employed which are essentially water. In the case of aftertreatment, for temperature in the last state of treatment the laundry items can be dried much easier, and above all much faster, after wet treatment. The water liquid exhibits a smaller degree of surface tension and is less viscous. This means that a larger percentage of liquid or moisture (bound liquor) held in the laundry items after the wet treatment can be mechanically removed from the laundry items. The remaining residual moisture of the laundry items is less that when using the conventional method, where colder liquid, barely above room temperature, is used in the last treatment zone, in particular in aftertreatment.

According to a preferred embodiment of the method, the liquid not bound in the laundry items (free liquor) is discharged before the laundry items are processed in the last treatment zone and replaced by warmer liquid. Processing in the last treatment zone is then carried out with liquid having a warmer temperature so that following this treatment, the liquor bound in the laundry items is of a higher temperature, meaning that after treatment a greater percentage of this bound liquor can be removed from the laundry items by mechanical means, such as by pressing or spin-drying. Thus only a relatively small percentage of the liquid or moisture must be removed from the laundry items in the subsequent drying stage.

It is advantageous to circulate the warmer liquid used in the last treatment zone. To this end the bound liquor largely separated from the laundry items by mechanical means, i.e. the liquid thereby formed, and preferably also the free liquor are circulated, if necessary back to the start of the last treatment zone. The recycled warmed liquid from the last treatment zone is preferably stored temporarily. To this end, the liquid of the bound liquor mechanically separated from the laundry items and in particular the free liquor as well are caught in a storage tank and, whenever needed, are led from it back to the subsequent laundry items at the start of the last treatment zone. The interim storage of the liquid of the bound liquor allows for an intermittent feeding of this liquid to the last treatment zone.

Also provided by the invention are means for reheating the liquid obtained, for example from a hydroextraction press, when it is returned to the start of the last treatment zone and/or in the interim or storage tank. In particular, the liquid is brought to a temperature such that, at the end of the wet treatment of the laundry items in the last treatment zone and in particular when the bound liquor is separated from the laundry items after the last treatment zone, the liquid of the bound liquor still has a temperature high enough which allows for most of the bound liquor to be separated from the laundry items.

According to the invention, the temperature in the last treatment zone is selected to lie in a range 20° C. to 40° C. above the average outer temperature and/or 10° C. to 50° C. above the temperature of the liquid at the end of the last treatment zone. Accordingly, the temperature of the liquid in the last treatment zone is approximately 40° C. to 80° C. For laundry items whose fabric can withstand higher temperatures, the liquid in the last treatment zone can also be greater than 80° C.

The temperature of the liquid when it is fed into the last treatment zone is preferably about 60° C. In contrast, the temperature of the previous treatment zone is only about 30° C.

The stated temperatures of the liquid in the last treatment zone, in particular a temperature in the range of approximately 60° C., means that when a portion of the bound liquid is mechanically separated from the laundry items the temperature of the liquid or moisture in the laundry items is always significantly greater than the ambient temperature or the temperature of the liquid at the end of the preceding treatment zone. In practice, this temperature lies only a few degree below the intake temperature of approximately 60° C.

In the following, a preferred embodiment of the invention will be explained in more detail on the basis of a single FIGURE in the drawing. This shows a schematic side view of a possible apparatus for implementing the method according to the invention.

The apparatus shown here is a continuous tunnel washing machine 10 with additional components shown in part. In the tunnel washing machine 10 laundry items (not shown), which may involve all types of textiles, such as clothing and flat fabrics, are washed in batches and, if necessary, then put through an aftertreatment. In the embodiment shown, the aftertreatment involves a finishing process for the laundry items.

The tunnel washing machine 10 has a elongate drum 11, which can be driven in rotation about a horizontal longitudinal center line 12. The drum 11 of the tunnel washing machine 10 is divided into various treatment zones, namely a washing zone 13, a rinse zone 14 and a finishing zone 15. The washing zone 13, rinse zone 14 and finishing zone 15 are successively arranged in the drum 11 of the tunnel washing machine 10 in the direction of treatment 16. The washing zone 13 and the rinse zone 14 are formed from a plurality of washing chambers 17 and rinse chambers 18 (only a few of these being shown in the drawing) which follow one another in the longitudinal direction of the drum 11. The direction of treatment 16 also runs in the longitudinal direction of the drum 11. The number of successive washing chambers 17 and rinse chambers 18 of the washing zone 13 and rinse zone 14 may vary according to the size and capacity of the tunnel washing machine 10. The finishing zone 15 in the apparatus according to the invention requires only a single finishing chamber 18. If necessary, however, a plurality of successive finishing chambers 19 can be provided.

Provided upstream of the drum 11 of the tunnel washing machine 10 is an loading hopper 20, through which the laundry items to be washed can be conveyed into the washing zone 13 of the tunnel washing machine 10. The laundry items are let down (flushed) into the tunnel washing machine 10 through the addition of liquids, in particular water, whereby the essentially dry laundry items located in the region of the loading hopper 20 are dampened and conveyed, or flushed, along with a stream of liquid into the tunnel washing machine 10.

Arranged downstream of the tunnel washing machine 10 is a dehydration device, which in the shown exemplary embodiments is a hydroextraction press 21. Once washed and, if necessary, finished, the laundry items exit the tunnel washing machine 10 through the finishing chamber 19 and are transferred directly from it via a short connecting chute 22 to the hydroextraction press 21. In the hydroextraction press 21 the liquid still in the laundry items conveyed out of the tunnel washing machine 10 is separated from the laundry items, primarily by being pressed out of the laundry items, which afterwards contain only a relatively small amount of residual moisture, meaning that only very little liquid is still bound to the laundry items (bound liquor). The liquid separated from, in particular pressed out of, the laundry items in the region of the hydroextraction press 21, namely bound and free liquor, is gathered in a collecting basin 23 located below the hydroextraction press 21.

In the apparatus shown here, the hydroextraction press 21 as well as the finishing chamber 19 are each assigned a storage tank 24 and 25. The two storage tanks 24 and 25 are configured such that they can receive liquids, preferably different liquids, separate from one another. The liquid in storage tank 24 can therefore not be mixed with the liquid in storage tank 25.

A discharge pipe 27 leads from the lowest point in the finishing chamber 19, in particular from a sump-like projection 26 (connecting box) in the bottom of the finishing chamber 19, to the storage tank 24. The discharge pipe 27 can be shut off when necessary, preferably by means of a two-way valve 28 which can be automatically actuated.

A discharge pipe 29 leads from the hydroextraction press 21, namely from its collecting basin 23, to a three-way valve 30 which preferably can be automatically actuated. Two discharge pipe legs 31 and 32 lead from the three-way valve 30 to each of the two storage tanks 24 and 25. In this way, liquid coming from hydroextraction press 21 can be directed optionally to storage tank 24 or storage tank 25 by the corresponding actuation of the three-way valve 30. In the exemplary embodiment shown, a pump 33 is provided in the discharge pipe between the collecting basin 23 and the three-way valve 30. This pump can be omitted if the storage tanks 24 and 25 are arranged so that the liquid coming from the collecting basin 23 can run into the storage tanks 24 and 25 by gravity flow.

Provided at the bottom of each storage tank 24 and 25 is a downpipe 34 and 35, respectively, which are closed by a two-way valve 36, which can be manually operated, and which can be opened whenever needed by a corresponding actuation of the two-way valve 36. The down pipes 34 and 35 lead to a waste water drain. This permits the discharge of superfluous, overly used or dirty water from the storage tank 24 or 25 as needed.

A return pipe 37 branches off the storage tank 25 and leads to the finishing chamber 19, preferably to an inlet above the finishing chamber 19. The return pipe 37 is assigned a pump 38 through which the liquid, in particular the finishing liquid, can be circulated back from the storage container 25 to the finishing chamber 19.

A return pipe branch 39 and 40 proceeds from the bottom of each storage container 24 and 25, respectively. The return pipe branches 39 and 40 lead to a mutual, preferably automatically activated, three-way valve 41. Here the return pipe branches 39 and 40 unite in a return pipe 42 connected to the three-way valve 41. The return pipe 42 leads to the start of the tunnel washing machine 10, namely to the loading hopper 20. The return pipe 42 is also assigned a pump 43.

In the following, the method according to the invention will be described in more detail as based on the apparatus shown in the FIGURE and already set forth above.

The laundry to be handled is fed into the tunnel washing machine 10 through the loading hopper 20. This is carried out with the addition of liquid, in particular water, which is fed into the loading hopper 20, for example as delivered by the return pipe 42. This flushes the laundry items to be handled into the tunnel washing machine 10. From the loading hopper 20 the laundry items and the liquid enter the washing zone 13, where they are washed in successive washing chambers 17. Following the washing zone the laundry items enter the rinse zone 14, where they are progressively rinsed in a plurality of rinse chambers.

In the following it will be assumed that the washed laundry is to be subjected to an aftertreatment in the form of a finishing process. This finishing process is carried out in the last treatment zone, here finishing zone 15. In the shown exemplary embodiment, this has a single finishing chamber 19, but it may also have a plurality of chambers. The laundry items enter the finishing chamber from the last rinse chamber 18 along with the rinsing liquid. Rinse liquid not bound to the laundry items (free liquor) is first removed from the finishing chamber 19 by feeding the rinse liquid collecting in the projection 26 at the bottom of the finishing chamber 19 through the discharge pipe 27 and the open two-way valve 28 to the storage tank 24. Here the rinse water is collected and temporarily stored. The temperature of the rinse water is only marginally higher than the ambient temperature (room temperature), in that it is only approximately 30° C., for example.

After the unbound rinse liquid has been discharged from the finishing chamber 19, the finishing liquid is fed into the finishing chamber 19. The finishing liquid enters the finishing chamber 19 by being sent from the storage tank 25, through the return pipe branch 39 and the correspondingly switched three-way valve 41, and through the return pipe 37 to the top of the finishing chamber 19. In the process, the finishing liquid is pumped by the pump 43 into the finishing chamber 19. The finishing process is then carried out in the finishing chamber 19 with the laundry items contained therein.

According to the invention, the finishing liquid, or also any other liquid, has a higher temperature than the rinse liquid previously discharged into the storage tank 24. The temperature of the aftertreatment liquid in the final zone, namely here the finishing zone 15, of the tunnel washing machine 10 depends on the type of laundry items being handled, in particular on the fabric material of same. As a rule, the aftertreatment liquid has a temperature that is between 10° C. and 50° C. greater than the temperature of the rinse liquid The temperature of the finishing liquid is thus approximately 40° C. to 80° C. Preferably the temperature of the finishing liquid or of another liquid in the last treatment zone is approximately 60° C. This temperature is essentially maintained by the finishing liquid. This temperature therefore does not drop by any significant degree in the finishing zone 15.

Once the finishing process of the laundry items is completed in the finishing chamber 19, the laundry items and the remaining unbound finishing liquid (free liquor) are transferred out of the finishing chamber 19 via the connecting chute and fed into the hydroextraction press 21 or some other dehydration apparatus. In the process, unbound finishing material (free liquor) flows directly into the collecting basin 23 of the hydroextraction press 21. Most of the finishing liquid still bound in the laundry items (bound liquor) is now pressed out of the laundry items by the hydroextraction press 21 and also flows into the collecting basin 23. The finishing liquid separated from the laundry items in this manner is led from the collecting basin 23 through the discharge pipe 29, the appropriately switched three-way valve 30 and the discharge pipe leg 31 to the storage tank 25 for receiving the finishing liquid, which is temporarily stored here until it is used for the next finishing process in the finishing chamber 19. In this manner the finishing liquid is circulated. If the finishing liquid is exhausted, it can be fed from the storage container 25 through the return pipe branch 39 with the appropriately positioned three-way valve 41 of the return pipe 42 and via the latter to the loading hopper 20 before being pumped through the tunnel washing machine 10, in the same way as the rinse liquid is normally conveyed from the storage tank 24. However, it is also conceivable to dispose of the exhausted aftertreatment liquid as waste water.

The finishing liquid led into the storage tank 25 still has a higher temperature than the rinse liquid temporarily stored in the storage tank 24. If this temperature of the finishing liquid is not sufficient for reuse, the finishing liquid is heated in the storage container 25 or, if necessary, at some other location until reaching the temperature required for being reused as finishing fluid. To ensure that the finishing liquid loses as little energy as possible during its interim storage in the region of the storage container 25, the latter is preferably thermally insulated.

The fact that the invention provides for the finishing liquid having a higher temperature as the rinse liquid, for example, results in the warming of the laundry items containing a certain percentage of the finishing liquid in the bound liquor. The warm finishing liquid has less surface tension and a correspondingly lower viscosity. It has been demonstrated that, when pressing the bound liquor out of the laundry items, liquid can be separated in a greater quantity than would be possible if colder finishing liquid were used. Through the use of warm or warmer finishing liquid, the laundry items contain a relatively minor residual moisture after the bound liquor has been pressed out. Only this slight amount of residual moisture must be removed from the laundry items by subsequent drying. This can be done more quickly and above all with less expenditure of energy because in commercial laundries, which employ the tunnel washing machines 10 referred to here, laundry items are dried by the introduction of energy, such as warm air.

From the proceeding it is also clear that the method according to the invention makes it possible to store rinse liquid and finishing liquid (or other types of liquids used in the aftertreatment of the laundry items) temporarily in separate storage tanks 24 und 25 and in particular to circulate the finishing liquid from the storage container 25 through the return pipe 37 to the finishing chamber 19, and from the latter via the hydroextraction press 21 back to the storage tank 25. Rinse water is removed from the finishing chamber 19 before the latter is filled with warmer finishing liquid, thus avoiding any mixing of colder rinse liquid with the warmer finishing liquid, except for the rinse liquid bound in the laundry items. The alkaline rinse liquid is also circulated in that it is pumped out of its storage tank 24 through the return pipe 42 and back into loading hopper 20 upstream of the tunnel washing machine 10, where it is used to flush in the laundry items to be washed. There is no need to add detergents to "neutralize" the liquid, since only liquid which is alkaline, but not acidic, is used to flush the laundry items. Thus, the method also saves on detergents.

What is claimed is:

1. Method for the wet treatment of laundry items, by subjecting the laundry items to different wet treatments in successive treatment zones, and with at least a part of any liquid remaining in the laundry items after a last wet treatment being separated from the laundry items after the last wet treatment, wherein the improvement comprises employing a liquid in last wet treatment whose temperature is higher than the temperature of liquid remaining in the preceding treatment zone at the end of the preceding treatment.

2. Method according to claim 1, characterized in that before the laundry items are treated in the last treatment zone, unbound liquid in the laundry items is separated from the laundry items, and then liquid having a higher temperature than the unbounded liquid is being added to the laundry items in the last treatment.

3. Method according to claim 1, characterized in that liquid in the last treatment zone is circulated into and out of said treatment zone.

4. Method according to claim 3, characterized in that the circulated liquid of at least the last treatment zone is intermediately stored outside of said treatment zone.

5. Method according to claim 4, characterized in that the circulated liquid outside of said treatment zone is heated, while in intermediate storage.

6. Method according to claim 4, characterized in that the circulated liquid is heated while in intermediate storage.

7. Method according to claim 1, characterized in that after the laundry items have been treated in the last treatment zone, unbound liquid in the laundry items is mechanically separated from the laundry item and the temperature of liquid in the last treatment zone is set such that after at least a greater portion of the unbound liquid in the laundry items has been mechanically separated, said the unbound liquid has a temperature greater than the temperature of liquid used in the preceding treatment zone.

8. Method according to claim 1, characterized in that liquid in the last treatment zone has a temperature between 20° Celsius and 60 ° Celsius greater than the average room temperature.

9. Method according to claim 1, characterized in that the liquid in the last treatment zone has a temperature between 10° Celsius and 50 ° Celius greater than the temperature of the liquid used in the preceding treatment zone.

10. Method according to claim 1, characterized in that the last treatment zone is an aftertreatment zone and the laundry items in the aftertreatment zone are treated with water.

11. Method according to claim 10, characterized in that the aftertreatment liquid has a temperature of at least 40° Celius.

12. Method according to claim 10, characterized in that the aftertreatment liquid has a temperature of at least 60° Celius.

13. Method according to claim 10, characterized in that the aftertreatment zone is a finishing zone and the laundry items are treated in the finishing zone with a warm finishing liquid.

14. Method according to claim 13, characterized in that the finishing liquid has a temperature of at least 40° Celius.

15. Method according to claim 13 characterized in that the finishing liquid has a temperature of at least 60° Celius.

* * * * *